United States Patent [19]

Millager

[11] Patent Number: 4,960,162

[45] Date of Patent: Oct. 2, 1990

[54] METHOD OF RECLAIMING FOUNDRY SAND

[75] Inventor: Richard J. Millager, Beaverton, Oreg.

[73] Assignee: Esco Corporation, Portland, Oreg.

[21] Appl. No.: 312,630

[22] Filed: Feb. 17, 1989

[51] Int. Cl.[5] ..... B02C 19/12; B02C 23/20

[52] U.S. Cl. ..... 164/5; 210/770; 241/DIG. 10

[58] Field of Search ..... 164/5; 241/DIG. 10; 210/770

[56] References Cited

U.S. PATENT DOCUMENTS

| | | | |
|---|---|---|---|
| 2,261,947 | 11/1941 | Barnebl et al. | 164/5 |
| 2,331,102 | 10/1943 | Bird | 164/5 X |
| 2,420,392 | 5/1947 | Christensen et al. | 164/5 X |
| 2,783,511 | 3/1957 | Will et al. | 164/5 X |
| 3,403,784 | 10/1968 | Blumberg | 210/770 |
| 4,008,856 | 2/1977 | Sears | 241/DIG. 10 X |
| 4,685,973 | 8/1987 | Ashton | 164/5 X |

FOREIGN PATENT DOCUMENTS

| | | | |
|---|---|---|---|
| 1097431 | 6/1984 | U.S.S.R. | 164/5 |
| 1276424 | 12/1986 | U.S.S.R. | 164/5 |

OTHER PUBLICATIONS

Wile, L. E. "Sand Reclamation at Lynchburg Foundry" in *Foundry Trade Journal,* vol. 94, No. 1903, Feb. 19, 1953, pp. 207–214.

*Primary Examiner*—Richard K. Seidel
*Assistant Examiner*—J. Reed Batten, Jr.
*Attorney, Agent, or Firm*—Tilton, Fallon, Lungmus & Chestnut

[57] ABSTRACT

Foundry sand lumps containing a water soluble binder are broken down to grain size, mechanically scrubbed to remove slime-forming impurities, dust and some of the binder, washed to remove substantially all the remaining binder and provide a sand/water slurry, pressure filtered and dried.

5 Claims, 1 Drawing Sheet

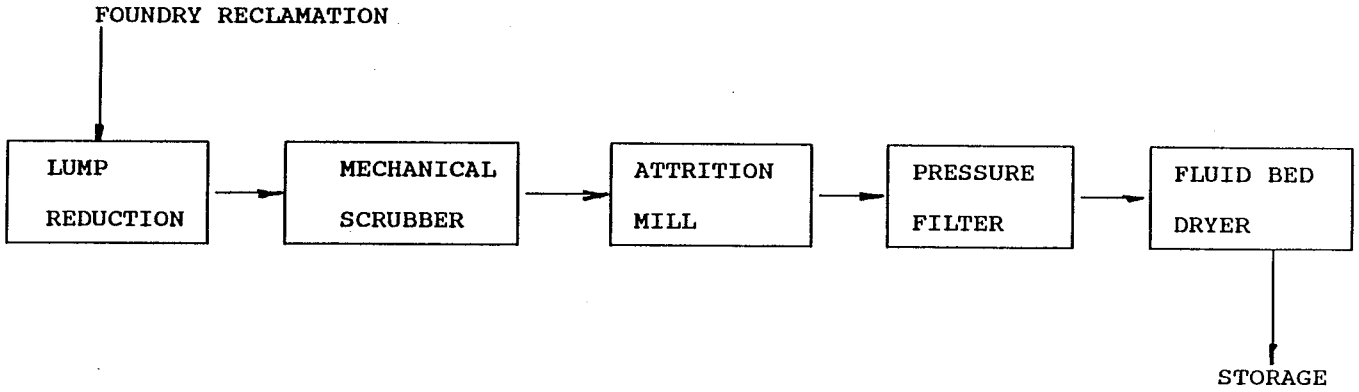
FOUNDRY RECLAMATION
LUMP REDUCTION
MECHANICAL SCRUBBER
ATTRITION MILL
PRESSURE FILTER
FLUID BED DRYER
STORAGE

METHOD OF RECLAIMING FOUNDRY SAND

BACKGROUND AND SUMMARY OF INVENTION:

This invention relates to a method of reclaiming used foundry sand and, more particularly to sodium silicate bonded sand resulting from foundry casting methods.

An especially vexing problem has been the cost of purchasing new zircon sand and the disposition of the used zircon sand. Current prices of zircon sand can run $450/ton. Then, when used, an environmental problem occurs. Since this sand is at least mildly radioactive, the location of a dump site is difficult. Heat recovery processes are almost economically prohibitive, viz., energy intensive, and previous "wet" sand processes have not worked satisfactorily.

I have found that a sequence of steps results in the satisfactory reclamation of sand (both the above-mentioned zircon sand and silica sand or any sand that is bonded with a water soluble binder), which include: delumping, mechanical scrubbing, water washing to provide a sand/water slurry, pressure filtration and drying.

Details and advantages of the invention can be seen in the ensuing specification. The invention is described in conjunction with the accompanying drawing which is a block diagram of the steps involved.

DETAILED DESCRIPTION

The invention is described in conjunction with the accompanying drawing and the following example.

EXAMPLE

For the practice of the invention in Portland, Oregon, certain pieces of equipment were used which were able to reclaim 3 tons/hour. It will be apparent that other pieces of equipment may be employed depending upon the volume of sand, availability of equipment, space limitations, etc.

The first step is to "delump" the used foundry sand—normally referred to as "lumps". These may have a substantial variation in size, depending on how the sand mold is broken up, the size of the casting, etc. In the practice of the invention to which this example is directed, the size range was up to about 40 lbs. per stone.

I employ for this step a Vibra-Mill Model No. VM-64 manufactured by General Kinematics Corp. of Barrington, Ill. 60010. This consists of an open topped box or chamber mounted for vibrating motion and equipped with a bottom screen. Lumps are introduced into the open top and grain sized sand is removed from the bottom. Although foundry sand normally has a size of from about 40–270 mesh, I employ a 12 mesh screen. Subsequent processing in the mechanical scrubber attrition mill reduces any grains to the normal specification. These readily handle grains to up to ⅛" size which pass through the 12 mesh screen. Foundry sand normally has a size of from about 40 to about 270 mesh. It was possible in this specific example to use a chamber bottom screen having 12 mesh size. The resulting reduction occurs in the mechanical scrubber attrition mill. The 3 tons of lumps were fed intermittently, viz., an additional charge was added to fill the chamber to about 6,000 lbs. (3 tons) when the level dropped to about ⅓ from the bottom.

MECHANICAL SCRUBBING

The second step consisted of subjecting the grain-size particles of sand to mechanical scrubbing and, in the example given, a surge tank was interposed between the vibrating mill and the mechanical scrubber. The scrubber was Pneu-Tek Model No. 32-3TPH Sand Reclamation Unit manufactured by Wheelabrator-Frye Inc. of Mishawaka, Ind. 46534. The action of the air on the sand removes dust and some of the binder normally employed in making casting molds. Here, the binder employed was the usual sodium silicate. Most advantageously, this step removes those impurities which create a "slime" in the slurry subsequently employed in the practice of the invention.

ATTRITION MILL

The third step involves water washing of the scrubbed sand particles which removes substantially all the remaining binder. This machine is built in house and is much like a washing machine having two propeller blades. The water addition ultimately resulted in a slurry of 14 gallons of water per cubic foot of sand. The slurry concentration may vary from about 0.05 to about 0.10 cubic feet of sand per gallon of water.

PRESSURE FILTER

The fourth step is pressure filtration in a Model No. HC-12 Automatic Pressure Filter manufactured by Oberlin Filter Co. of 1931 MacArthur Road, Waukesha, Wis. 53188. Normally such equipment is used in food processing, particularly beer. There the filtrate is recovered while the filter cake is discarded. Here I do the reverse and reclaim the sand while sewering the filtrate. The filter employed air actuated platen to press sufficient water from the sand to achieve about 5% moisture content in the pressed sand.

FLUID BED DRYER

The last step is to convey the filtered sand to a fluidized bed dryer. Employed was a Model No. QAD/C (2×15'6") Carrier Fluid Bed Dryer/Cooler, manufactured by Carrier Vibrating Equipment of Louisville, Ky. 40233. This was a gas fired dryer which reduced the moisture content to below about 0.5%. This is the normal specification of moisture content of purchased sand. Thereafter, the dried sand was transported to storage for subsequent use.

While in the foregoing specification a detailed description of an embodiment of the invention has been set down for the purpose of illustration, many variations in the details hereingiven may be made by those skilled in the art without departing from the spirit and scope of the invention.

I claim:

1. A method of reclaiming binder-containing foundry sand containing a water soluble binder comprising:

reducing lumps of used sand resulting from a foundry casting process to grain size, mechanically cleaning said grain-sized sand to remove wash-inhibiting impurities and a portion of said binder, waterwashing said mechanically-cleaned sand to remove substantially all the remaining binder and to provide said sand in water slurry form, pressing said sand slurry with an air-loaded platen to reduce the moisture content to about 5%, and drying said pressed sand to reduce the moisture content to less than about 1/2%.

2. The method of claim 1 in which said sand is zircon sand.

3. The method of claim 1 in which said binder is sodium silicate.

4. The method of claim 1 in which said grain size is up to about 12 mesh.

5. The method of claim 1 in which said slurry has a concentration of about 0.05 to about 0.10 cubic feet of sand per gallon of water.

* * * * *